United States Patent [19]

Cooper et al.

[11] Patent Number: 4,846,249

[45] Date of Patent: Jul. 11, 1989

[54] WINDOW SHADE CARRIER AND CARRIER ASSEMBLY

[75] Inventors: David Cooper, North Hollywood; Suresh K. Wadhwani, Northridge; Michael Praamsma, Van Nuys, all of Calif.

[73] Assignee: Castec, Inc., North Hollywood, Calif.

[21] Appl. No.: 142,174

[22] Filed: Jan. 11, 1988

[51] Int. Cl.[4] ..... A47H 5/032

[52] U.S. Cl. ..... 160/345; 16/87.4 R; 16/89; 16/93 D; 16/102

[58] Field of Search ..... 16/87.2, 87.4 R, 89, 16/93 R, 93 D, 95 R, 95 D, 95 DW, 95 W, 102; 160/340, 341, 344, 345

[56] References Cited

U.S. PATENT DOCUMENTS

| | | | |
|---|---|---|---|
| 297,627 | 4/1884 | Page et al. | 160/345 X |
| 615,009 | 11/1898 | Bennett et al. | 16/95 DW X |
| 841,044 | 1/1907 | Perry | 16/87.4 R |
| 2,736,055 | 2/1956 | Bell | 16/95 D |
| 2,832,362 | 4/1958 | Critoph | 160/84.1 X |
| 3,098,520 | 2/1963 | Greenstadt et al. | 160/346 |
| 3,137,890 | 6/1964 | Kochanowski | 160/84.1 X |
| 3,251,400 | 5/1966 | Krull | 16/93 D X |
| 3,522,621 | 8/1970 | Ford et al. | 16/87.4 R |
| 3,585,674 | 6/1971 | Golden | 16/87.6 R |
| 3,983,921 | 10/1976 | Ford | 160/341 |
| 4,473,102 | 9/1984 | Ohman et al. | 160/345 |
| 4,557,310 | 12/1985 | Castellaw et al. | 160/84.1 |

FOREIGN PATENT DOCUMENTS

| | | | |
|---|---|---|---|
| 1382590 | 11/1964 | France | 16/93 D |
| 2028637 | 3/1980 | United Kingdom | 16/95 D |

*Primary Examiner*—Fred A. Silverberg
*Attorney, Agent, or Firm*—John J. Posta, Jr.

[57] ABSTRACT

The window shade track hook carrier includes a body of plastic, metal, ceramic or the like which is adapted to slide or roll freely in a shade track and bear a depending shade hook which is adapted to extend out of an opening in the bottom or side of the track. The carrier body has a window shade cord passageway extending longitudinally therethrough for holding such cord in the track. The track passageway is preferably lined with slippery plastic, smooth metal or the like low friction material to reduce abrasion of the cord and facilitate relative movement of the carrier and cord in the track. In one embodiment the body has a pair of body-centering rotatable wheels of plastic or the like disposed on opposite sides of the body. In another embodiment, the body has a pair of low friction skids on opposite sides of the body. In a third embodiment, the body is cylindrical and solid, with a low friction exterior, curved sidewalls and flat front and rear. The carrier provides improved performance and protection of the window shade cord.

3 Claims, 2 Drawing Sheets

WINDOW SHADE CARRIER AND CARRIER ASSEMBLY

BACKGROUND OF THE INVENTION

1. FIELD OF THE INVENTION

The present invention relates to window shade equipment and, more particularly, to an improved type of window shade track hook carrier.

2. PRIOR ART

Various types of window shade track hook carriers are known. See, for example, the carriers illustrated and described in U.S. Pat. Nos. 3,137,890 and 4,557,310. Certain other carriers are shown in German Patent No. 1,270,759. U.S. Pat. Nos. 2,832,362 deal, respectively, with rectractile awning equipment and folding door components. The carriers disclosed in the described patents do not uniformly slide or roll easily within their tracks. Improvement in that respect would be desireable. Moreover, none of such devices disclose hook carriers adapted for guiding, protecting, handling and receiving window shade cords. In many instances, window shade cords are left unprotected, tend to become dirty and frayed and present an unsightly appearance.

It would be desireable to provide an improved window shade hook carrier adapted to more easily slide or roll in a track while guiding and protecting a window shade cord against soilage and fraying and also preventing the cord from presenting an unsightly appearance.

SUMMARY OF THE INVENTION

The improved window shade track hook carrier satisfies all the foregoing needs. The carrier is substantially as set forth in the Abstract. Thus, it comprises a preferably solid body of plastic, metal, ceramic or the like bearing centering movement facilitating means in the form of side skids or wheels or curved sidewalls, so that it can roll or slide easily and smoothly within a window shade track.

The body includes a depending shade hook adapted to hang out of the bottom of the track. Moreover, the body has a window shade cord passageway extending longitudinally therethrough for guiding the cord in the track. The passageway preferably is lined with slippery plastic, smooth metal or the like low friction material to reduce cord abrasion and facilitate movement of the carrier along the cord in the track.

Further features of the improved carrier of the present invention are set forth in the following detailed description and accompanying drawings.

DRAWINGS

DETAILED DESCRIPTION

Figure 1:
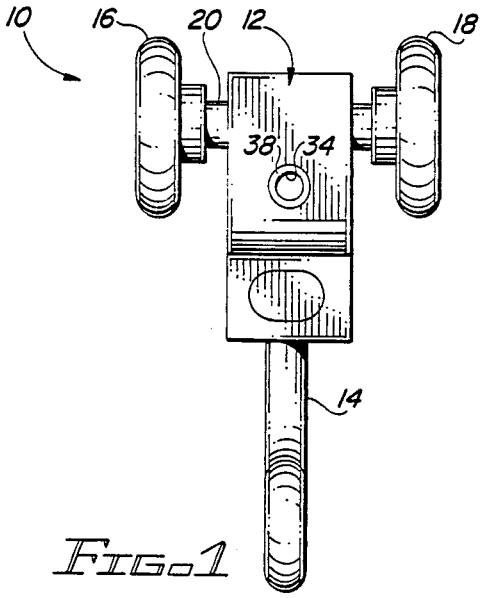
FIG. 1 is a schematic front elevation of a first preferred embodiment of the improved window shade track hook carrier of the present invention.
Figure 2:
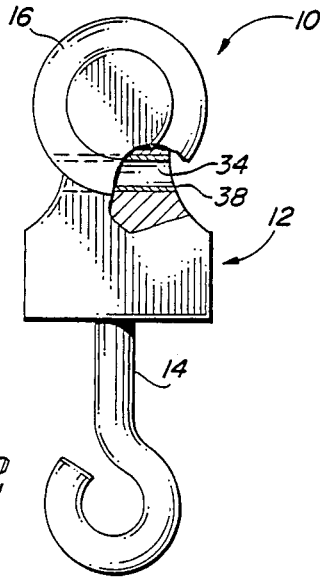
FIG. 2 is a schematic side elevation, partly broken away, of the carrier of FIG. 1.

FIGS. 1–4.

Now referring more particularly to FIGS. 1–4 of the drawings, a first preferred embodiment of the improved window shade track hook carrier is shown schematically therein. Thus, carrier 10 is shown which comprises a solid body 12, preferably of durable plastic such as polystyrene, polyester, nylon, tetrafluoroethylene, polyethylene, polypropylene or the like thermoplastic or thermosetting material. However, body 12 can also be metal, ceramic, glass, fiberglass, hardwood or the like.

Body 12 is preferably generally rectangular and bears a depending window shade hook 14 of durable material, preferably steel, such as that of body 12. Body 12 can be of any suitable shape and can be hollow instead of solid. Body 12 bears centering and movementpromoting means, in this instance a pair of wheels 16 and 18 secured for rotation on opposite sides of body 12 by a transverse axle 20 passing through body 12.

Figure 3:
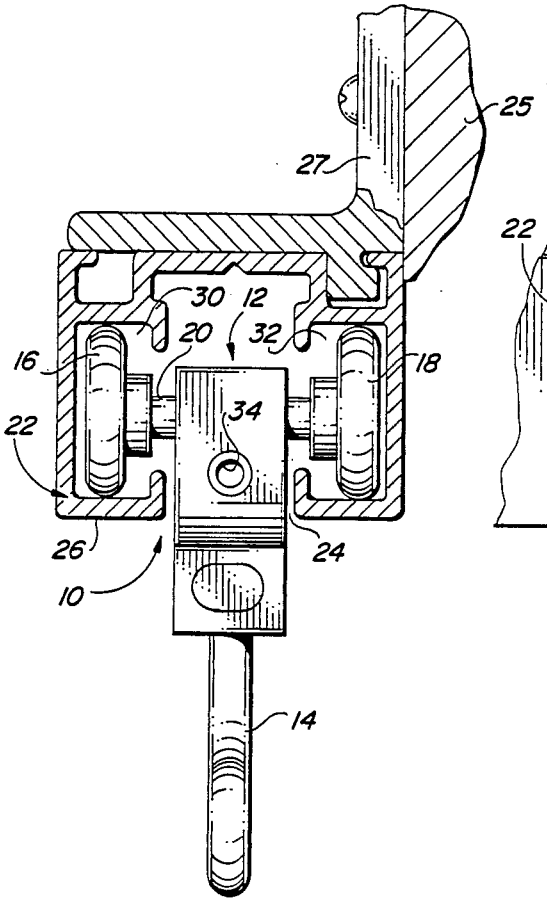
FIG. 3 is a schematic front view, partly in section, of the carrier of FIG. 1 disposed in an operative position in a window shade track.

Wheels 16 and 18 and body 12 are dimensioned to fit within any suitable window shade track such as track 22 (FIG. 3). Track 22 includes a central longitudinal opening 24 in the bottom 26 thereof down through which hook 14 and the lower portion 28 of body 12 extend, suspended by wheels 16 and 18 disposed in compartments 30 and 32, respectively, in track 22 on opposite sides of opening 24. Track 22 is shown held in place against a mullion 25 by an L-bracket 27. Wheels 16 and 18 can roll freely longitudinally in compartments 30 and 32, bearing body 12 and hook 14 with them along track 22.

Figure 4:
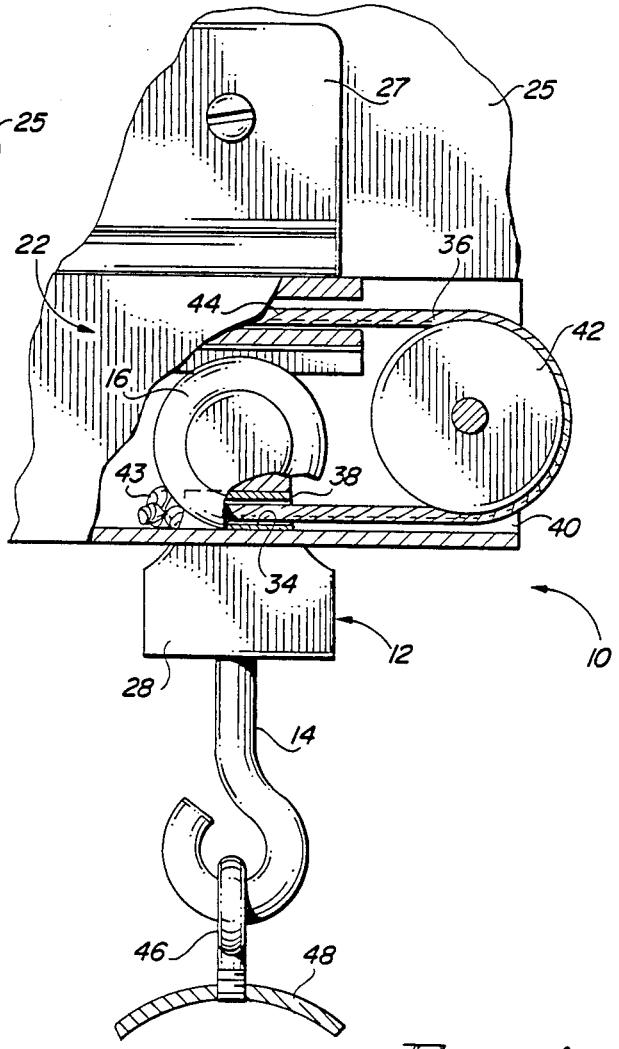
FIG. 4 is a schematic side elevation, partly broken away, of the carrier and track of FIG. 3, shown at one end of the track with one end of the shade cord knotted and abutting the carrier and the rest of the cord passing therethrough and trained around a pulley wheel.

Carrier 10 can be inserted into track 22 from an end of track 22 so that carrier 10 is in the operative position shown in FIGS. 3 and 4. It will be understood that a track different in configuration from track 22 could be used to house carrier 10 and that a number of carriers 10 are usually disposed at spaced intervals along the length of track 22.

An important feature of carrier 10 is that it has a generally cylindrical passageway 34 extending therethrough above portion 28 so that passageway 34 is in track 22. Passageway 34 is dimensioned to allow the free passage of window shade cord 36 therethrough and of carrier 10 over cord 36. In order to facilitate such free passage, passageway 34 may be lined with a tube 38 of low friction material, such as tetrafluoroethylene, if body 12 is not already fabricated of such material. Alternatively, tube 38 may be of polished or another smooth metal such as bronze, brass, steel, copper or the like.

Passageway 34 has the advantage of allowing carrier 10 to slide easily over cord 36 while supporting cord in track 22, protected from dirt, abrasion and snagging. Cord 36 has the added function of helping to center carrier 10 in track 22. Accordingly, cord 36 is not exposed to view.

In FIG. 4, carrier 10 is shown adjacent front end 40 of track 22. End 40 is fitted with a pulley 42 around which cord 36 is trained. One end of cord 36 passes through passageway 34 and is tied into a knot 42 so that it cannot be pulled forward through passageway 34 and detached therefrom. Movement of the upper reach 44 of cord 36 rearwardly above carrier 10 in track 22 pulls carrier 10 forward. Hook 14 is shown engaged with an eye screw 46 threadably connected to a lead stay 48 for movement thereof. Carrier 10 is compact, durable, inexpensive, and efficient in holding and moving shade components attached to hook 14.

Figure 5:
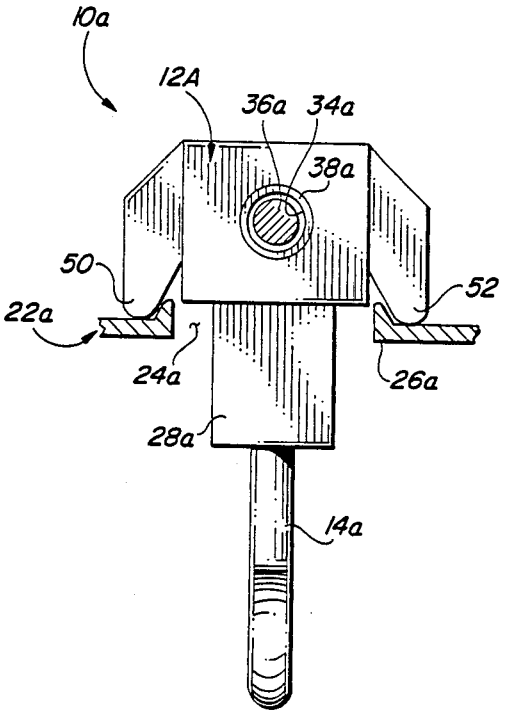
FIG. 5 is a schematic front elevation, partly broken away, of a second preferred embodiment of the improved carrier of the present invention in a window shade track.
Figure 6:
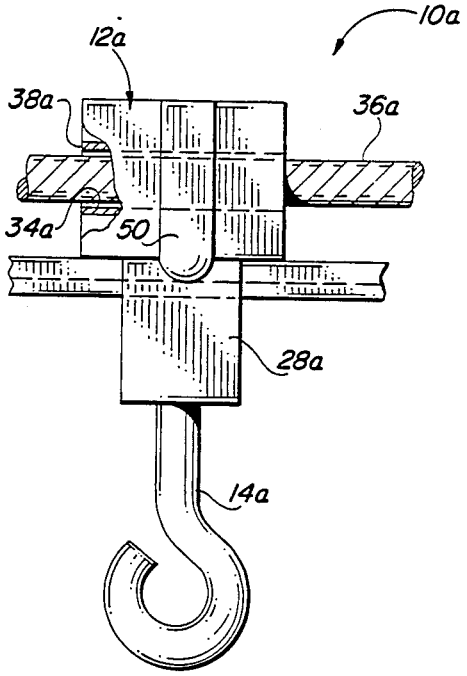
FIG. 6 is a schematic side elevation, partly broken away, of the carrier of FIG. 5.

FIGS. 5 and 6.

A second preferred embodiment of the improved carrier of the present invention is schematically depicted in FIGS. 5 and 6. Thus, carrier 10*a* is shown. Components thereof similar to those of carrier 10 bear the same numerals but are succeeded by the letter "a". Carrier 10*a* is substantially identical to carrier 10 except for the following:

Carrier 10*a* has a pair of depending low friction side skids 50 and 52 connected to opposite sides of body 12*a*. above portion 28*a*, which skids 50 and 52 facilitate the slidng of carrier 10*a* in track 22*a*, which is substantially identical to track 22. Skids 50 and 52 can be of low friction polytetrafluoroethylene or metal or the like and are disposed on opposite sides of opening 24*a* in bottom 26*a*, down through which portion 28*a* and hook 14*a* extend. Body 12 contains longitudinal passageway 34*a* lined with a low friction tube 38*a* of polytetrafluoroethylene, polished metal or the like through which cord 36*a* passes. Carrier 10*a* slides easily along the interior of track 22*a* and has the advantages of carrier 10.

Figure 7:
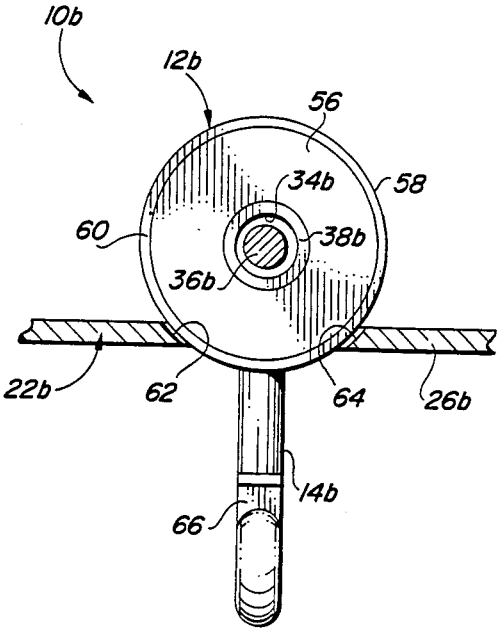
FIG. 7 is a schematic front elevation, partly broken away, of a third preferred embodiment of the improved carrier of the present invention, shown disposed in a window shade track; and, FIG. 8 is a schematic side elevation, partly broken away, of the carrier of FIG. 7.
Figure 8:
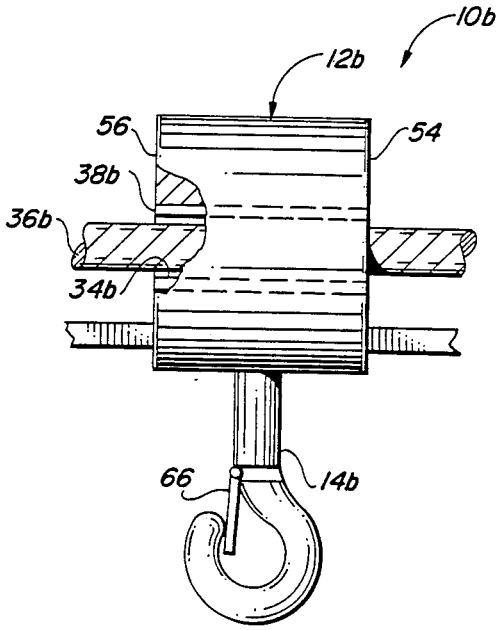

FIGS. 7 and 8.

A third preferred embodiment of the improved carrier of the present invention is schematically depicted in FIGS. 7 and 8. Thus, carrier 10*b* is shown. Components thereof similar to those of carrier 10 or 10*a* bear the same numerals but are succeeded by the letter "b".

Carrier 10*b* is substantially similar to carrier 10 except that body 12*b* is a cylinder with a flat front 54, flat rear 56 and curved sides 58. Sides 58 are sheathed in a low friction sleeve 60 of smooth metal or plastic so that sleeve 60 contacts the side edges of bottom 26*b* of track 22*b* defining opening 24*b*. Side edges 62 and 64 are sloped and smooth to facilitate sliding of carrier 10*b* in track 22*b* in contact therewith.

Hook 14*b* depends from body 12*b* through opening 24*b* and bears a spring loaded latch plate 66 or the like. Passageway 34*b* is in the center of body 12*b* and is lined with a smooth low friction metal or plastic tubular sleeve 38*b* which permits easy relative sliding of cord 36*b* and carrier 10*b*. Carrier 10*b* has substantially the advantages of carriers 10 and 10*a*.

Various other modifications, changes, alterations and additions can be made in the improved carrier of the present invention, its components and their parameters. All such modifications, changes, alterations and additions as are within the scope of the appended claims form part of the present invention.

What is claimed is:

1. An improved window shade track carrier in combination with a longitudinally extending one piece track assembly having a right track which is a substantially mirror image of a left track, each track of which has:

(1) a closed vertical outer side, (2) a horizontally extending top side with a downwardly extending top lip; and, (3) a horizontally extending bottom side with an upwardly extending lip, said track assembly further including a longitudinally extending channel, where in said carrier comprises:

(a) a main body portion having a transversely extending opening therein and a longitudinally extending opening therein said longitudinally extending opening being below said transversely extending opening, (b) an axle disposed in said transversely extending opening, (c) a first wheel rotatably secured to one end of said axle, (d) a second wheel rotatably secured to the opposite end of said axle, (e) a separate hook member secured to and depending from said main body portion, (f) wherein said first and second wheels are respectively disposed within said left and right tracks for movement therealong while lateral movement thereof is respectively restricted by said vertical outer sides and said upwardly and downwardly extending lips, (g) wherein said axle passes through and is movable along the longitudinally extending slot formed by and between the ends of said lips, (h) wherein a part of said main body portion passes downwardly through and is movable along the longitudinally extending slot formed by and between the sides of said lips, (i) wherein a cord passes through said longitudinally extending opening in said main body portion and said longitudinally extending channel in said track assembly, (j) wherein a force applied to said cord enables movement of said carriage along said track.

2. The improved carrier of claim 1 wherein said main body portion is made of plastic.

3. The improved carrier of claim 2 wherein said hook member is made of metal.

* * * * *